US012644596B2

(12) United States Patent
Goh et al.

(10) Patent No.: US 12,644,596 B2
(45) Date of Patent: Jun. 2, 2026

(54) GAS FURNACE WITH HEAT EXCHANGER

(71) Applicant: Daikin Comfort Technologies Manufacturing, L.P., Waller, TX (US)

(72) Inventors: Sien Fong Goh, Cypress, TX (US); Jianmin Zhang, Katy, TX (US)

(73) Assignee: Daikin Comfort Technologies Manufacturing, L.P., Houston, TX (US)

( * ) Notice: Subject to any disclaimer, the term of this patent is extended or adjusted under 35 U.S.C. 154(b) by 499 days.

(21) Appl. No.: 18/183,215

(22) Filed: Mar. 14, 2023

(65) Prior Publication Data

US 2024/0310039 A1 Sep. 19, 2024

(51) Int. Cl.
*F23D 14/48* (2006.01)
*F23D 14/62* (2006.01)

(52) U.S. Cl.
CPC ..... *F23D 14/48* (2013.01); *F23D 14/62* (2013.01)

(58) Field of Classification Search
CPC ..... F23D 14/48; F23D 14/62
USPC ..... 431/354; 126/110 C, 110 A
See application file for complete search history.

(56) References Cited

U.S. PATENT DOCUMENTS 1,071,053 A * 8/1913 Hunter ..... F23D 14/06 261/76
5,108,284 A * 4/1992 Gruswitz ..... F23D 14/04 431/114
6,860,734 B2 3/2005 Zia et al.
6,880,548 B2 4/2005 Schultz et al.
8,919,337 B2 12/2014 Schultz et al.
10,995,965 B2 5/2021 Maricic et al.
2013/0213379 A1* 8/2013 Schultz ..... F24H 3/08 165/173
2013/0302737 A1 11/2013 Schultz et al.
2015/0369495 A1* 12/2015 Maricic ..... F23D 14/58 126/104 A
2021/0140632 A1 5/2021 Park et al.

FOREIGN PATENT DOCUMENTS

KR 1020020096529 A 12/2002
KR 1020100020341 A 2/2010
KR 1020100035362 A 4/2010
KR 1020200069980 A 6/2020

OTHER PUBLICATIONS

International Search Report and Written Opinion dated Jun. 28, 2024 issued in related PCT Application No. PCT/US2024/017463 filed Feb. 27, 2024.

* cited by examiner

*Primary Examiner* — Vivek K Shirsat

(57) ABSTRACT

A furnace assembly has a fuel gas manifold connectable to a fuel gas supply that has fuel gas nozzles connectable to inshot burners. Each burner fires a flame and includes an air entrance section and a static air mixer including vanes with the mixer configured to fully mix the flow of fuel gas and the flow of ambient air flowing through the mixer into a fully mixed mixture. Each burner also includes a metal fiber mesh burner surface defines a surface where combustion of the fully mixed mixture occurs to create the flame. The furnace assembly also includes a heat exchanger in communication with the inshot burners and comprising tubes and a blower downstream of the heat exchanger and in fluid communication with the tubes and operable to create a negative pressure in the heat exchanger and pull the flows of fuel gas and ambient air into the burners.

20 Claims, 5 Drawing Sheets

GAS FURNACE WITH HEAT EXCHANGER

BACKGROUND

This section is intended to introduce the reader to various aspects of the art that may be related to various aspects of the presently described embodiments—to help facilitate a better understanding of various aspects of the present embodiments. Accordingly, it should be understood that these statements are to be read in this light, and not as admissions of prior art.

A residential furnace includes a heat exchanger ("HX") that has a bank of heat exchange tubes arranged such that air circulated by a blower passes between the tubes to be heated before the heated air passes to a distribution duct. Each of the tubes has an inlet end into which the flame of a burner extends to heat and combust a fuel such as natural gas, an outlet end which is fluidly connected to an inducer for drawing the heated gas therethrough, and a plurality of passes through which the heated flue gas passes. The fuel, for example, natural gas, is combusted in the burner. The combustion gas, flue gas, is routed through the HX, which extracts the heat therefrom. The flue gas heats the surface of the HX and an air stream is blown across the exterior of the HX, thus removing heat from the HX by convection.

Burning any fossil fuel can result in many undesirable byproducts such as NOx, SOx, and COx. Many countries and regions now require that fossil fuel burning equipment comply with air quality standards and limitations. The particulars of these requirements vary widely depending on the industry or equipment being regulated as well as the particular geographic location in which the equipment is to be installed or operated.

Many regions have enacted emissions standards for furnaces and other HVAC equipment. In particular, many regions are currently, or will soon be, enforcing tougher standards for NOx emissions. Burning fossil fuels is generally done in the presence of air, which is essentially a mixture of O2 and N2. As a result, this process has a tendency to generate at least some quantity of NOx, which may be increased when the amount of air mixed with the fuel is not controlled. Higher amounts of NOx are expected as the combustion temperature increases, so proper mixing of the fuel and air and adequate excess air can reduce the overall combustion temperature and NOx generation.

Traditionally, an inshot style of burner uses a single flame injection site that lends itself to higher temperature zones in an elongated flame. Moreover, these burners do not have precise air regulation mechanisms and are therefore generally designed to have a high level of excess air in order to assure clean combustion. For current commercial furnaces, these factors combine to generate NOx emissions higher than the minimum requirements of new and upcoming standards and regulations. Failure to comply with these new standards imposes harsh penalties, including a complete ban on the sale and installation of any product that is not compliant. Thus, a need exists to create a new burner system that is compatible with current furnace design yet has low NOx emission.

SUMMARY

Certain aspects of some embodiments disclosed herein are set forth below. It should be understood that these aspects are presented merely to provide the reader with a brief summary of certain forms the invention might take and that these aspects are not intended to limit the scope of the invention. Indeed, the invention may encompass a variety of aspects that may not be set forth below.

Embodiments of the present disclosure generally relate to a gas furnace for use with a gas fuel that includes inshot burners and that are used to ignite the gas fuel. Each burner includes a static air mixer that includes vanes configured to mix the flow of fuel gas and the flow of ambient air flowing through the mixer fully into a fully mixed mixture within the burner itself. The furnace also includes a heat exchanger assembly in communication with the burners and open to receiving the ignited flame, the heat exchanger assembly including tubes. The furnace also includes a blower downstream of the burners and the heat exchanger assembly and operable to pull ambient air into the burners as well as create a negative pressure within the heat exchanger.

Various refinements of the features noted above may exist in relation to various aspects of the present embodiments. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. Again, the brief summary presented above is intended only to familiarize the reader with certain aspects and contexts of some embodiments without limitation to the claimed subject matter.

BRIEF DESCRIPTION OF THE DRAWINGS

These and other features, aspects, and advantages of certain embodiments will become better understood when the following detailed description is read with reference to the accompanying drawings in which like characters represent like parts throughout the drawings, wherein.

DETAILED DESCRIPTION

One or more specific embodiments of the present disclosure will be described below. In an effort to provide a concise description of these embodiments, not all features of an actual implementation may be described. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments, the articles "a," "an," "the," and "said" are intended to mean that there are one or more of the elements. The terms "comprising," "including," and "having" are intended to be inclusive and mean that there may be additional elements other than the listed elements.

Figure 1:
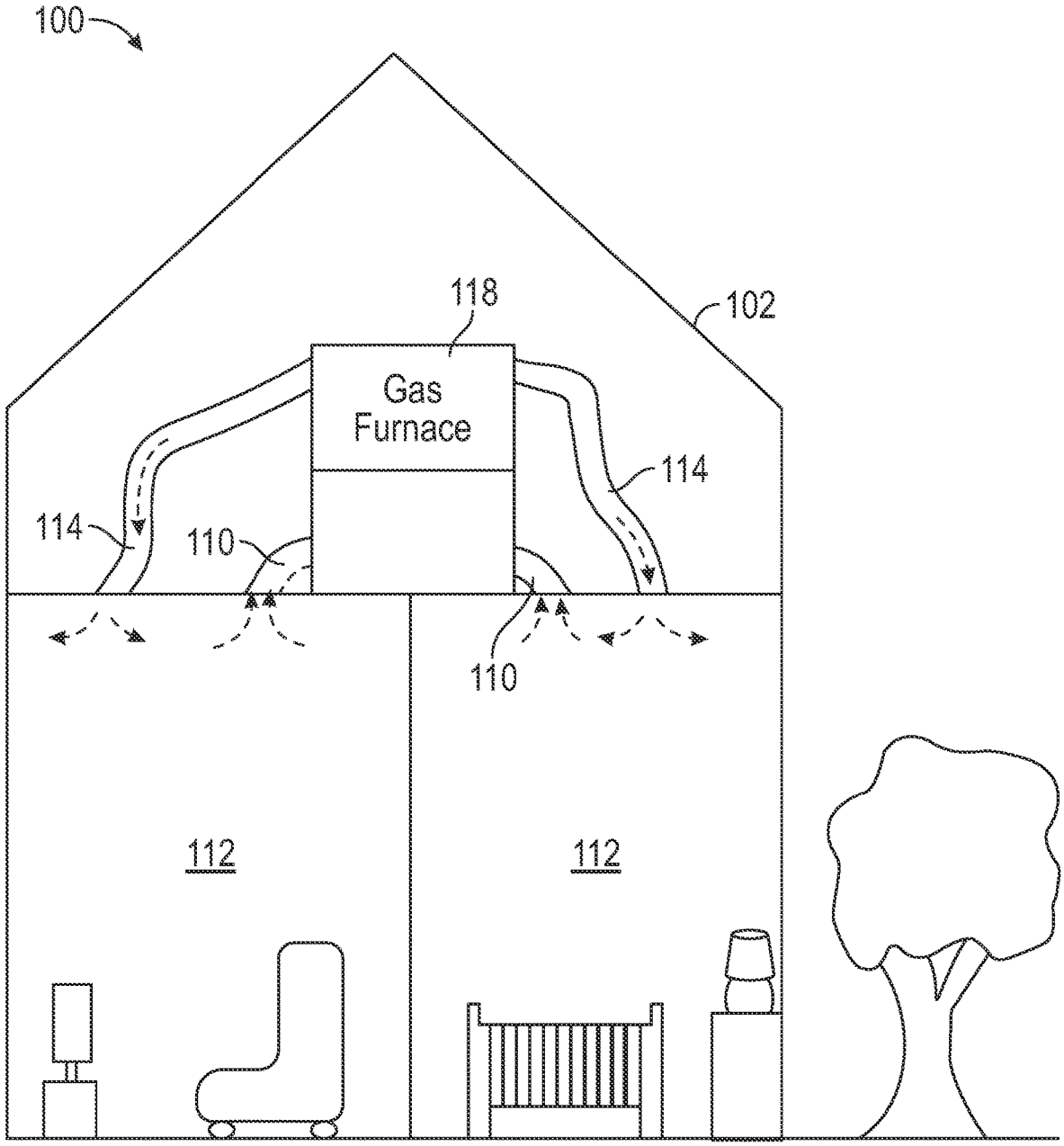
FIG. 1 is a schematic view a structure with a furnace, in accordance with one or more embodiments.

Turning to the figures, FIG. 1 illustrates a schematic of a heating system 100 in accordance with one or more embodiments. As depicted, the heating system 100 heats a residential structure 102. However, the concepts disclosed herein are applicable to numerous of heating situations, which include industrial and commercial settings.

To heat the structure 102, the heating system 100 draws ambient indoor air via returns 110, passes that air over a source of heating, and then routes the heated air back to the various climate-controlled spaces 112 through ducts or ductworks 114—which are relatively large pipes that may be rigid or flexible.

As shown, the heating system 100 includes a gas furnace 118. The gas furnace 118 combusts fuel, such as natural gas, to produce heat in furnace tubes (shown in detail below) that serpentine through the gas furnace 118. These furnace tubes act as a heating element for the ambient indoor air being pushed over the furnace tubes and into the ducts 114.

Figure 2A:
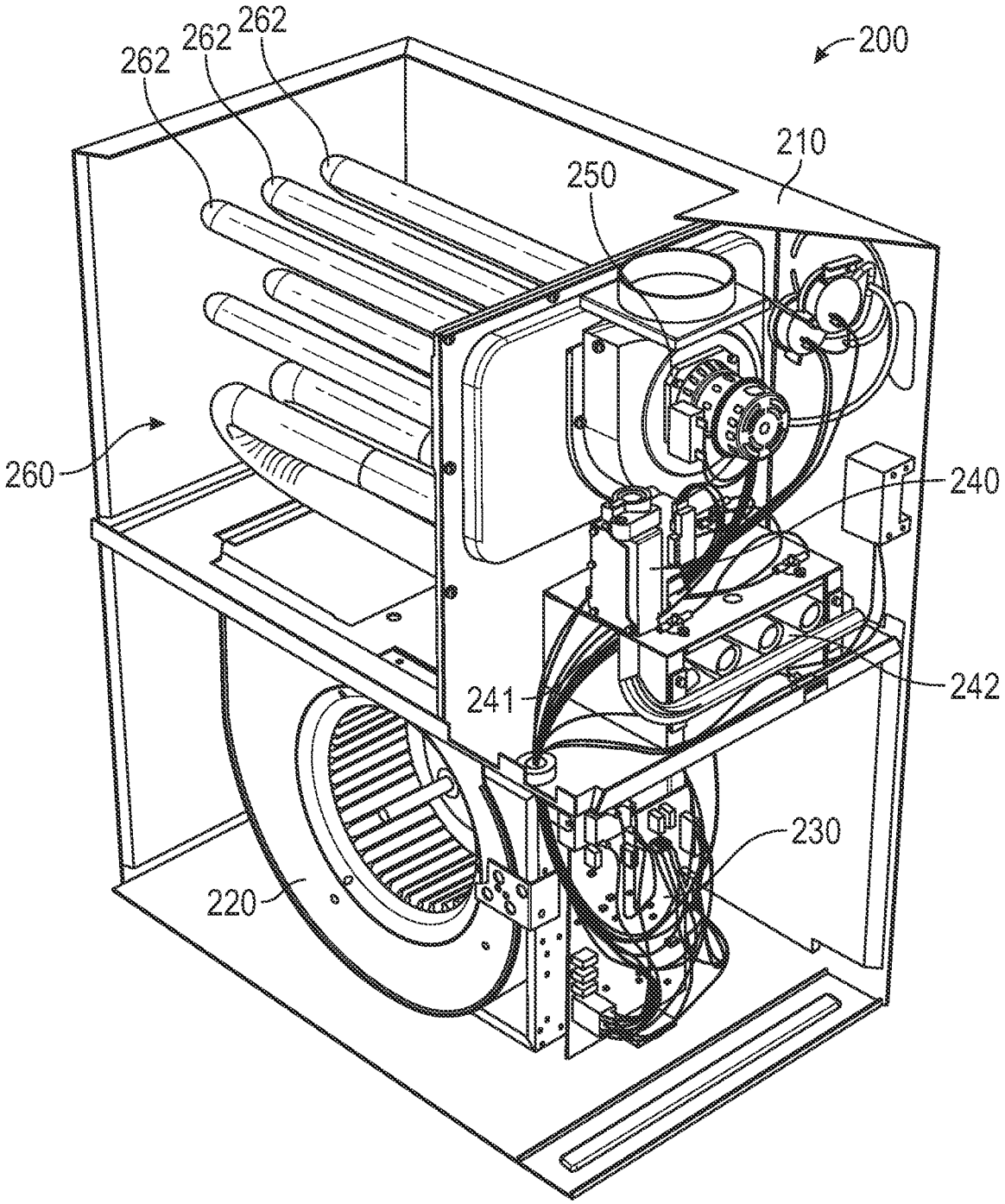
FIG. 2A is a schematic perspective view of the furnace assembly of FIG. 1.
Figure 2B:
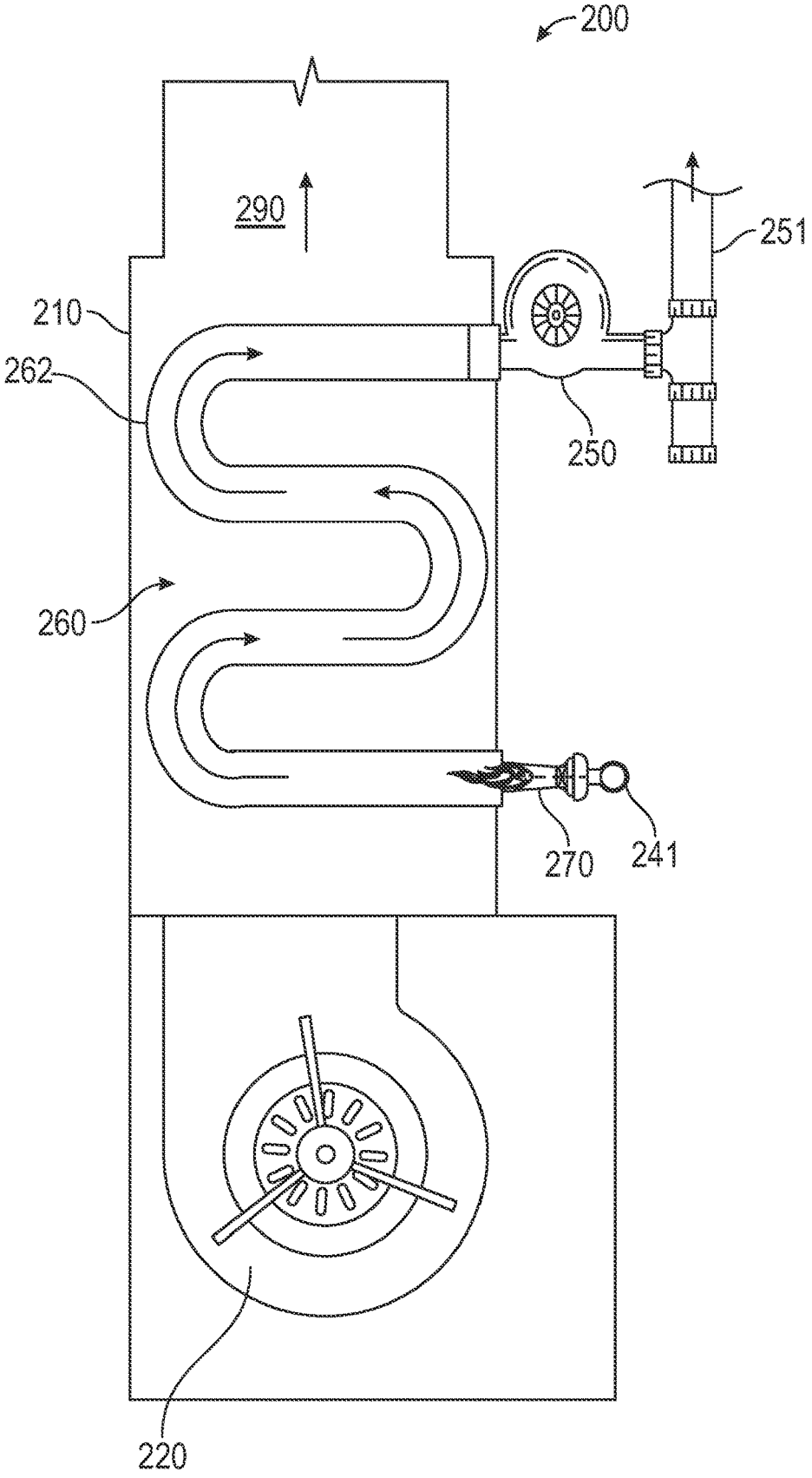
FIG. 2B is a schematic side view of the furnace assembly of FIG. 1.
Figure 2C:
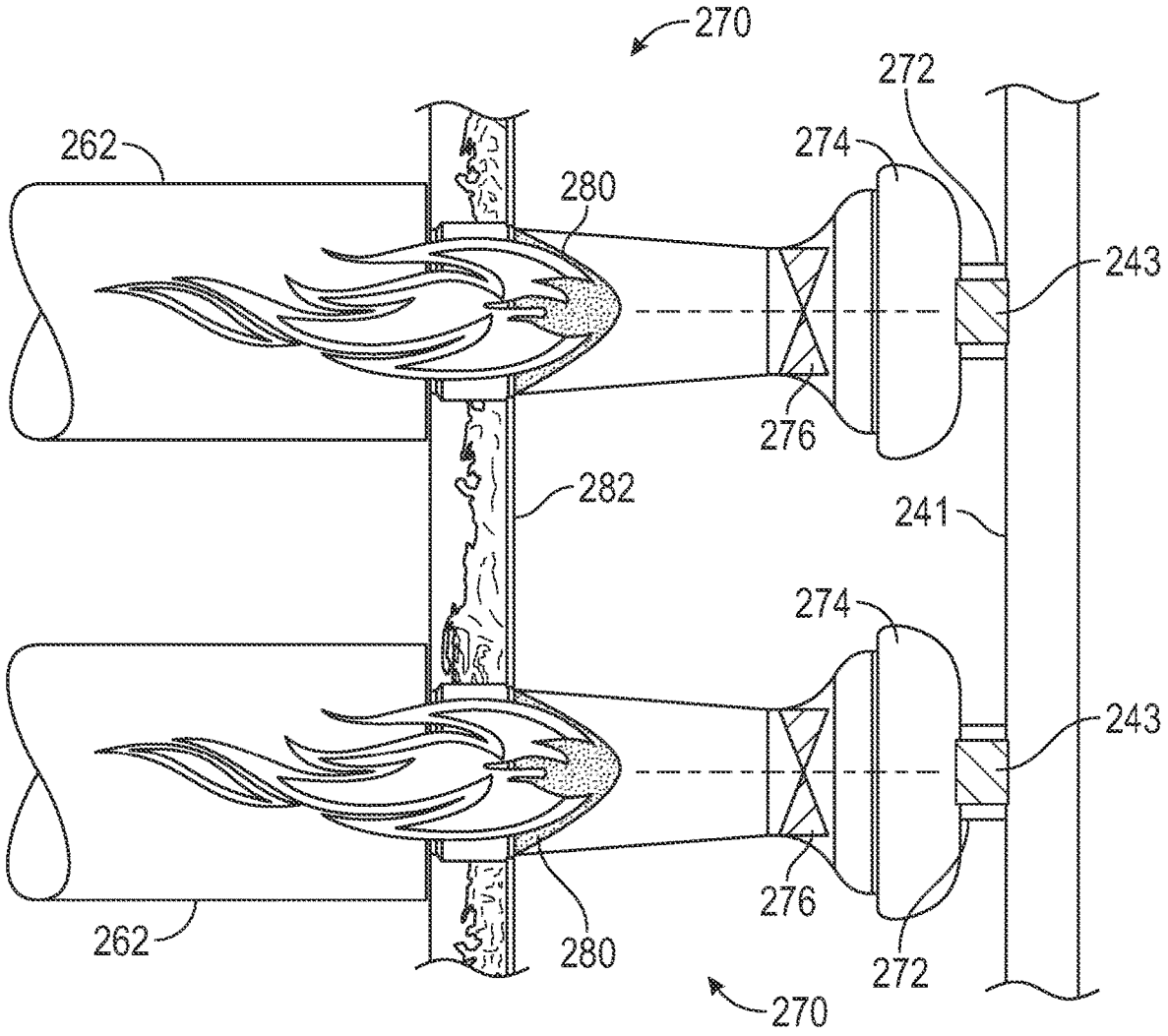
FIG. 2C is a schematic top view of inshot burners used in the furnace assembly of FIG. 1.
Figure 2D:
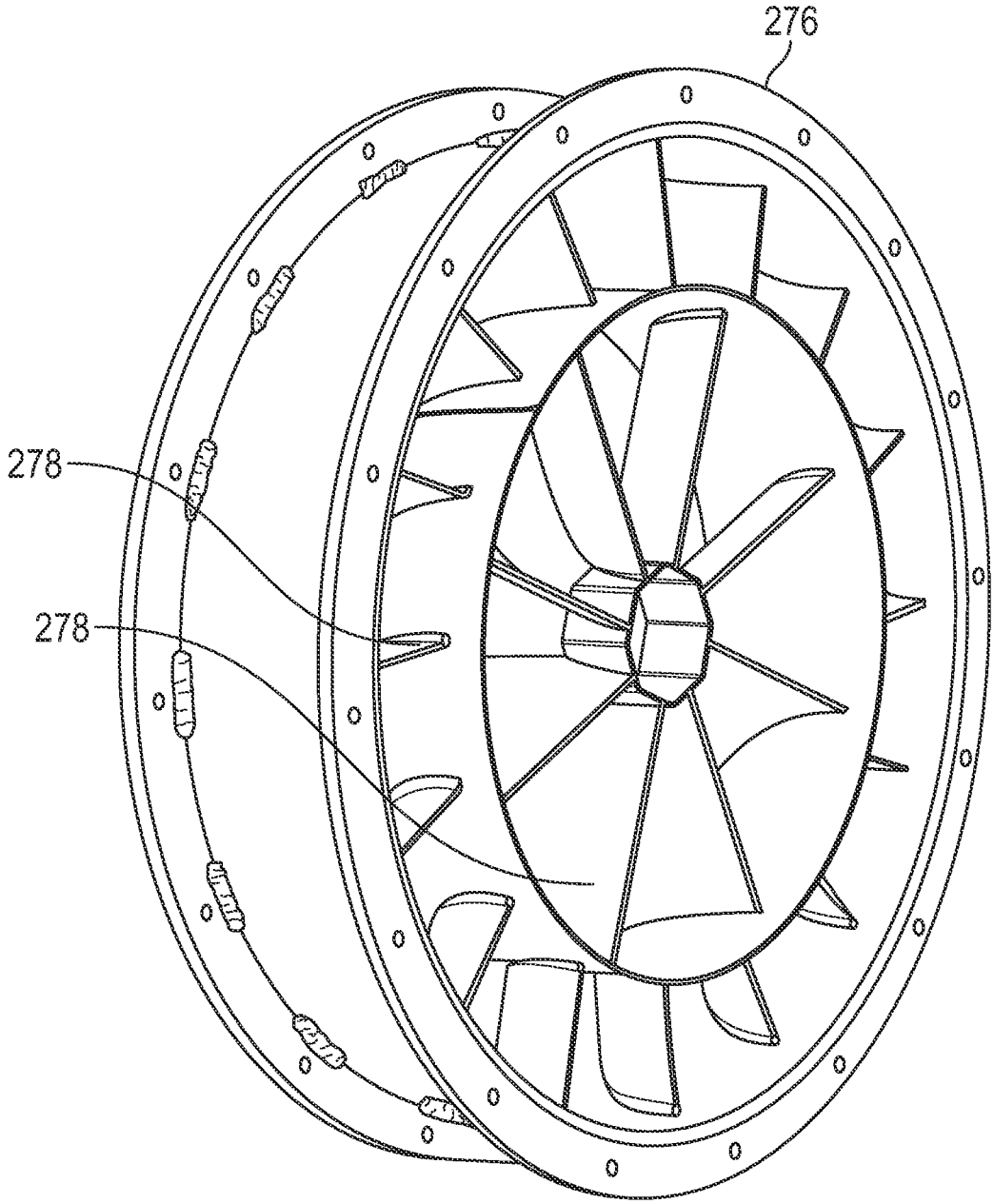
FIG. 2D is a schematic perspective view of an embodiment of a vaned static mixer used in an inshot burner in the furnace assembly of FIG. 1.

FIGS. 2A-C illustrate a perspective schematic view and a side schematic view respectively of a furnace assembly 200 that may be used as the furnace 118 shown in FIG. 1 as well as a schematic view of burners used in the furnace assembly 200. The furnace assembly 200 is described without limitation in terms of a gas-fired system. Those skilled in the pertinent art will appreciate that the principles disclosed herein may be extended to furnace systems using different gas fuel types, for example, natural gas, propane, or hydrogen. The furnace assembly 200 includes a cabinet 210 that may be made of, for example, heavy-gauge steel with a durable baked-enamel finish to resist corrosion and protect components inside the cabinet 210. In some locations, the cabinet may also be thermally insulated to reduce heat loss and maximize heat transfer efficiency as well as lower operation noise. The cabinet 210 encloses an air stream blower 220, which may be a variable-speed blower 220 for ramping up and down flow or an air stream according to the furnace performance demand. The cabinet 210 also encloses a controller 230 that may include self-diagnostic capabilities and may also continuously monitor and control the operation of the furnace assembly 200. To ignite and combust the gas fuel, the cabinet 210 also encloses a gas valve 240, which may be a two-stage valve.

For igniting and combusting the gas fuel, the furnace assembly 200 also includes a burner assembly 242, which includes an igniter such as a silicon nitride igniter that does not need a pilot light. The burner assembly 242 may optionally be enclosed in a burner box as illustrated. The burner assembly 242 also includes multiple inshot burners 270 connected to a fuel gas supply (not shown) through a fuel gas manifold 241. Each burner 270 includes a fuel gas nozzle retainer 272 configured to attach to a fuel gas nozzle 243 for receiving a flow of fuel gas into the burner 270 from the fuel gas manifold 241. Each burner 270 also includes an air entrance section 274 comprising an opening configured to allow the entrance of a flow of ambient air surrounding the burner 270 into the burner 270.

Each burner 270 further comprises a venturi tube section comprising a converging inlet section and a diverging outlet section that communicates through a restricted throat. Located in the throat is a static air mixer 276 that includes vanes 278 configured to mix the flow of fuel gas and the flow of ambient air flowing through the mixer fully into a fully mixed mixture. When a burner is ignited to produce a flame, the combustion of the fuel gas and ambient air flows as a fully mixed mixture allows the fully mixed mixture to be combusted more efficiently. Doing so reduces NOx emissions from the combustion of the fully mixed mixture compared to ambient air and fuel gas that are not fully mixed such as in some previous inshot burners. Such NOx reduction can be achieved at least due to less ambient air being needed in the fully mixed mixture for combustion. Additionally, combustion of a fully mixed mixture allows for a short flame to achieve complete combustion. For example, the flame may be greater than zero but less than four inches long. As another example, the flame may only be three inches long.

Located in the outlet section is a metal fiber mesh burner surface 280. The mesh burner surface 280 comprises a concave portion and defines a burner surface where combustion of the fully mixed mixture occurs to create the flame as shown. The metal fiber mesh is shaped to anchor the flame at the metal fiber mesh burner surface 280 and prevent the flame from being blown out. The mesh burner surface 280 may be a woven mesh made of stainless steel, stainless steel alloy, chrome, aluminum iron alloy, ceramic, or other suitable materials for withstanding combustion temperatures for the furnace fuel gas.

Shown more clearly in FIG. 2C, the burners 270 are in communication through a flame propagation passage 282. The flame propagation passage 282 is configured such that the flame in one burner 270 is capable of spreading as a secondary flame through the flame propagation passage 282 and igniting at least one adjacent burner 270. In this manner, only one, or at least not all, of the burners 270 needs to be ignited with an igniter to be able to ignite all of the burners 270 of the burner assembly 242.

The cabinet 210 also encloses a heat exchanger (HX) assembly 260 and an induced draft blower 250, which may be, for example, a variable-speed blower. The HX assembly 260 includes multiple tubes 262 that may be made of, for example, stainless steel. The HX assembly 260 works with the burner assembly 242 and the induced draft blower 250 to burn the heating fuel gas, e.g. natural gas, and move exhaust gases and combustion materials through the HX assembly 260 and out of the furnace 200. The burners 270 are located such that the combustion flames extend into the tubes 262 when ignited. Additionally, the outlet section of each burner 270 is located relative to a heat exchanger tube 262 to prevent ambient air from entering the heat exchanger tube 262 other than through the air entrance section 274 of each burner 270. Not entraining additional ambient air into the heat exchanger tubes 262 also reduces the noise associated with operating the furnace 200.

The blower 250 is located downstream of the burners 270 and the heat exchanger assembly 260 and is operable to pull ambient air into the burners 270 as well as create a negative pressure within the tubes 262 of the heat exchanger assembly 260. The negative pressure in the heat exchanger tubes 262 prevents leaks of combustion emissions out of the heat exchanger tubes 262. Instead, the combustion emissions are expelled out of the furnace 200 through an exhaust vent 251. Further, the controller 230 controls the blower 250 to control the amount of ambient air being pulled into each burner 270 and controls the gas valve 240 to control the amount of fuel gas being received by each burner 270 depending on load conditions on the furnace assembly 200. Additionally, the controller 230 controls the air stream blower 220 to move air over the HX assembly 260, thereby transferring heat from the exhaust gases to an airstream 290 (shown in FIG. 2B) forced over the HX assembly 260 by the blower 220.

In operation of the furnace assembly 200, fuel gas from a fuel gas supply is supplied to the fuel gas manifold 241 and controlled by a gas valve 240. The fuel gas then flows to each inshot burner 270 through fuel gas nozzles 243. The induced draft blower 250 downstream of the burners 270 and the heat exchanger tubes 262 operates to create a negative pressure in the burners and pull in ambient air into the air entrance sections 274 in the burners 270. The fuel gas and the ambient air in each burner 270 is mixed into a fully mixed mixture using a static air mixer comprising vanes located in the burner 270. Once mixed, the method includes igniting the fully mixed mixture in each burner 270 to produce a flame in each burner 270 at a metal fiber mesh burner surface 280 comprising a concave portion. Heat from the flames is transferred through tubes 262 of the heat exchanger assembly 260 in communication with the inshot burners using the blower 250. The heat is transferred by the blower 250 pulling the combustion emissions from the flame through the tubes 262. An airstream blower 220 operates to pass an air stream over an exterior of the heat exchanger tubes 262 to transfer heat to the air stream. The heated air stream then flows into the interior of the structure 102 through ducts 114 to heat the interior of the structure 102. The operation of the induced draft blower 250, the gas valve 240, and the air stream blower 220 are controlled using a controller 230 depending on the heating demand of the structure 102.

While the aspects of the present disclosure may be susceptible to various modifications and alternative forms, specific embodiments have been shown by way of example in the drawings and have been described in detail herein. But it should be understood that the invention is not intended to be limited to the particular forms disclosed. Rather, the invention is to cover all modifications, equivalents, and alternatives falling within the spirit and scope of the invention as defined by the following appended claims. For example, certain embodiments disclosed here envisage usage with a powered fan rather than an inducer fan, or no fan at all. Moreover, the rotating equipment (e.g., motors) and valves disclosed herein are envisaged as being operable at specified speeds or variable speeds through inverter circuitry, for example. Moreover, the internal and external communication of the furnace may be accomplished through wired and or wireless communications, including known communication protocols, Wi-Fi, 802.11(x), Bluetooth, to name just a few.

What is claimed is:

1. A furnace assembly for use with a fuel gas from a fuel gas supply, comprising:

a fuel gas manifold connectable to the fuel gas supply and comprising fuel gas nozzles;

inshot burners, each burner connectable to a fuel gas nozzle and configured to fire a flame and comprising:

a fuel gas nozzle retainer configured to attach to one of the fuel gas nozzles for receiving a flow of fuel gas into the burner;

an air entrance section comprising an opening configured to allow entrance of a flow of ambient air into the burner;

a venturi tube section comprising a converging inlet section and a diverging outlet section that communicates through a restricted throat;

a static air mixer located in the throat and comprising vanes configured to fully mix the flow of fuel gas and the flow of ambient air flowing through the mixer into a fully mixed mixture; and a metal fiber mesh burner surface located in the outlet section, wherein the mesh burner surface comprises a concave portion and defines a surface where combustion of the fully mixed mixture occurs to create the flame;

a heat exchanger in communication with the inshot burners and comprising tubes; and a blower downstream of the heat exchanger and in fluid communication with the tubes, the blower operable to create a negative pressure in the heat exchanger and pull the flows of fuel gas and ambient air into the burners.

2. The furnace assembly of claim 1, wherein the burners are in communication through a flame propagation passage such that the flame in one burner is capable of igniting at least one adjacent burner.

3. The furnace assembly of claim 1, wherein, when the burners are ignited, the flames are greater than zero and less than four inches long.

4. The furnace assembly of claim 1, wherein the metal fiber mesh comprises stainless steel.

5. The furnace assembly of claim 1, wherein the negative pressure in the heat exchanger prevents leaks of combustion emissions out of the heat exchanger.

6. The furnace assembly of claim 1, wherein each flame extends into a tube of the heat exchanger.

7. The furnace assembly of claim 1, further comprising a valve operable to regulate a pressure of the fuel gas in the fuel gas manifold.

8. The furnace assembly of claim 1, wherein the metal fiber mesh is shaped to anchor the flame at the metal fiber mesh burner surface and prevent the flame from being blown out.

9. The furnace assembly of claim 1, wherein the vanes are helically shaped.

10. The furnace assembly of claim 1, wherein the mixture being fully mixed reduces nitrous oxide emissions from the combustion of the fully mixed mixture compared to ambient air and fuel gas that are not fully mixed.

11. The furnace assembly of claim 1, wherein each burner outlet section is located relative to one of the heat exchanger tubes to prevent ambient air from entering the heat exchanger tube other than through the air entrance section of the burner.

12. An inshot burner for connecting to a fuel gas nozzle for firing a flame in a furnace assembly, comprising:

a fuel gas nozzle retainer configured to attach to the fuel gas nozzle for receiving a flow of fuel gas into the burner;

an air entrance section comprising an opening configured to allow entrance of a flow of ambient air into the burner;

a venturi tube section comprising a converging inlet section and a diverging outlet section that communicates through a restricted throat;

a static air mixer located in the throat and comprising vanes configured to fully mix the flow of fuel gas and the flow of ambient air flowing through the mixer into a fully mixed mixture; and a metal fiber mesh burner surface located in the outlet section, wherein the mesh burner surface comprises a concave portion and defines a surface where ignition of the fully mixed mixture occurs to create the flame.

13. The inshot burner of claim 12, further comprising a flame propagation passage configured such that the flame in the burner is capable of igniting another adjacent inshot burner.

14. The inshot burner of claim 12, wherein, when the burner is ignited, the flame is greater than zero and less than four inches long.

15. The inshot burner of claim 12, wherein the metal fiber mesh comprises stainless steel.

16. The inshot burner of claim 12, wherein the metal fiber mesh is shaped to anchor the flame at the metal fiber mesh burner surface and prevent the flame from being blown out.

17. The inshot burner of claim 12, wherein the vanes are helically shaped.

18. The inshot burner of claim 12, wherein the mixture being fully mixed reduces nitrous oxide emissions from combustion of the fully mixed mixture compared to ambient air and fuel gas that are not fully mixed.

19. A method of operating a furnace assembly for use with a fuel gas from a fuel gas supply to heat an interior of a structure, comprising:

supplying fuel gas from a fuel gas supply to a fuel gas manifold comprising fuel gas nozzles;

flowing fuel gas through the fuel gas nozzles to inshot burners;

operating a blower downstream of the nozzles to create a negative pressure in the burners and pull in ambient air into air entrance sections in the nozzles;

fully mixing the fuel gas and the ambient air in each burner into a fully mixed mixture using a static air mixer comprising vanes;

igniting the fully mixed mixture in each burner to produce a flame in each burner at a metal fiber mesh burner surface comprising a concave portion;

transferring heat from the flames through tubes of a heat exchanger in communication with the inshot burners using the blower that is also downstream of the heat exchanger and in fluid communication with the tubes;

passing an air stream over an exterior of the heat exchanger tubes to transfer heat to the air stream to produce a heated air stream; and flowing the heated air stream into the interior of the structure.

20. The method of claim 19, wherein igniting fully mixed fuel gas and the ambient air in each nozzle reduces nitrous oxide emissions from combustion of the fully mixed mixture compared to combusting ambient air and fuel gas that are not fully mixed.

* * * * *